United States Patent [19]

Schuster et al.

[11] 4,349,134

[45] Sep. 14, 1982

[54] VALVED, RESILIENT-WALLED CONTAINER FOR SAFELY DISPENSING FLAMMABLE LIQUIDS

[75] Inventors: Wilhelm Schuster; Jürgen Stahl; Wilhelm Wegner, all of Frankfurt, Fed. Rep. of Germany

[73] Assignee: AHK Alkohol Handelskontor GmbH, Fed. Rep. of Germany

[21] Appl. No.: 185,487

[22] Filed: Sep. 9, 1980

[51] Int. Cl.[3] ..... B65D 1/32; B65D 47/06

[52] U.S. Cl. ..... 222/212; 222/494; 222/497; 222/562

[58] Field of Search ..... 222/212, 213, 494, 496, 222/497, 562

[56] References Cited

U.S. PATENT DOCUMENTS

| | | | |
|---|---|---|---|
| 3,182,861 | 5/1965 | Nataf | 222/212 |
| 4,141,474 | 2/1979 | Nilson | 222/494 X |

FOREIGN PATENT DOCUMENTS

| | | | |
|---|---|---|---|
| 1586697 | 8/1970 | Fed. Rep. of Germany | 222/494 |
| 2305361 | 10/1976 | France | 222/494 |
| 582424 | 9/1958 | Italy | 222/494 |

*Primary Examiner*—Joseph J. Rolla
*Assistant Examiner*—Frederick R. Handren
*Attorney, Agent, or Firm*—Fidelman, Wolffe & Waldron

[57] ABSTRACT

A safety container for dispensing highly flammable liquids is described, which comprises flexible compressible container walls and a safety valve which is designed as a membrane-controlled cone valve, closable by a cap. The membrane exhibits a central hole bounded by a sealing edge, through which a valve cone is inserted and contacted by the sealing edge. The cone valve is operated by pressing the flexible container walls together and thereby reducing the interior space of the container and raising the internal pressure.

7 Claims, 4 Drawing Figures

(A - B)

VALVED, RESILIENT-WALLED CONTAINER FOR SAFELY DISPENSING FLAMMABLE LIQUIDS

The invention relates to a container particularly for dispensing highly flammable liquids, which comprises flexible compressible container walls, a safety closure means and a cap.

Such containers are known, e.g., as dispensers or dosing bottles for oil, petrol or household spirit. as spray containers for solvents etc. in a wide variety of constructions. They generally consist of a flexible plastic resistant to attack by the proposed container contents, which makes it possible to compress the container by squeezing its walls manually. The excess pressure then generated in the interior of the container discharges the container contents through an appropriately attached orifice. When the container is not in use the orifice is closed by a cap, which fits sealingly and prevents any evaporation of the contents or any spillage of the container in case of accidental pressure, shock or fall.

The principal danger in dealing with highly flammable liquids in closed containers is that, when the container contents are discharged into an open fire or onto a surface heated above the ignition point of the liquid, the flame may strike back into the container and make the container contents explode. Serious burns and injuries are a not infrequent consequence.

A degree of safety in handling highly flammable liquids is achieved with known containers by the arrangement of the smallest possible, e.g., nozzle-like, discharge orifice. For dispensing, the liquid is forced through the nozzle by pressure. The excess pressure generated in the container then prevents air from penetrating into the container for the duration of the withdrawal operation, so that a combustible liquid/air mixture is only produced downstream of the discharge orifice. If a jet of a highly flammable liquid is directed from a container of this kind into an open fire, then although this jet of liquid may itself ignite, it is improbable that the flame will strike back through the narrow nozzle orifice into the interior of the container during the discharge operation.

A reversal of the situation occurs as soon as it is intended to terminate the withdrawal of liquid and the pressure upon the container wall is relaxed for that purpose. When the elastic container walls rebound a partial vacuum is produced in the interior of the container, which is compensated by the inflow of air or of an ignitable air/gas mixture formed by the evaporation of liquid. In the least favourable case it is then possible for the flame to strike into the interior of the container and to cause an explosion.

It is the aim of the invention to produce a container of the type initially defined, which permits the liquid to be discharged into an open flame or onto a heated surface without any danger of the flame striking back into the interior of the container, and out of which an accurately dosed quantity of liquid can be dispensed if desired.

This aim is achieved by a container of the type initially defined, in that, as safety closure means, a membrane-controlled cone valve operable by reduction of the interior space of the container is provided, in which valve the membrane exhibits a central hole bounded by a sealing edge, through which a valve cone, which is abutted by the sealing edge, is engaged.

The valve cone serving as safety valve is closed in the rest state or inoperative state by the membrane sealingly abutting the valve cone. The membrane is then conveniently at least so strongly pretensioned that the closure means is not opened by the pressure of the liquid column alone even when the orifice is directed vertically downwards. In order to withdraw liquid the interior space of the container is reduced by compressing the container walls, thereby generating an excess pressure which opens the cone valve. Upon a pressure drop in the interior of the container, initiating the end of the withdrawal operation, the cone valve is closed without delay by the pretension of the membrane. Even when the container is set down, the partial vacuum which now prevails in the interior of the container, and the deformation of the container walls caused by the withdrawal of the liquid, persist initially. The penetration of a flammable air/gas mixture into the interior of the container is therefore excluded and any possible explosion danger is obviated.

In order to effect the pressure equalisation in the interior of the container, the valve cone of the cone valve is pressed slightly inwards, whereby the membrane is released out of the sealing seat. A passage is then created between the valve cone and the membrane, through which air enters until the pressure equalisation has occurred. Since this process takes place by manual pressure upon the valve cone tip, the container is located at a safe distance from any open flame, so that striking back and consequent accidental ignition are practically impossible.

The safety closure means according to the invention combines the functions of a stop valve engageable from the interior of the container with those of a manually operated ventilating valve.

In a particularly advantageous embodiment the membrane seals with a conical sleeve adapted to the shape of the valve cone. The necessary pretension of the membrane and the movement play required for lifting from the valve cone can be provided by membrane corrugations arranged concentrically about the hole or the sleeve. Where a sufficiently elastic membrane material is used, however, the conformation of a plane membrane surface is likewise possible. In order to withdraw liquid the sleeve of the membrane is lifted from its sealing seat on the valve cone by excess pressure generated in the interior of the container. The valve cone itself is mounted elastically resiliently in the axial direction, and for the purpose of ventilating the container it is manually movable away from the membrane so that the latter is released from the valve cone. The axial movement of the membrane towards the interior of the container is conveniently limited by a stop.

The container according to the invention is further secured by the fact that the membrane is pressed against the valve cone by the cap and simultaneously closes and seals the interior space of the applied cap.

Lastly an accurate dosing of the liquid to be dispensed is permitted in simple manner by indentations shaped in the container wall, which form a stop and limit the reduction of the interior space of the container when the walls are pressed together.

The invention is explained more fully with reference to an exemplary embodiment illustrated in the accompanying drawings, wherein.

Figure 1:
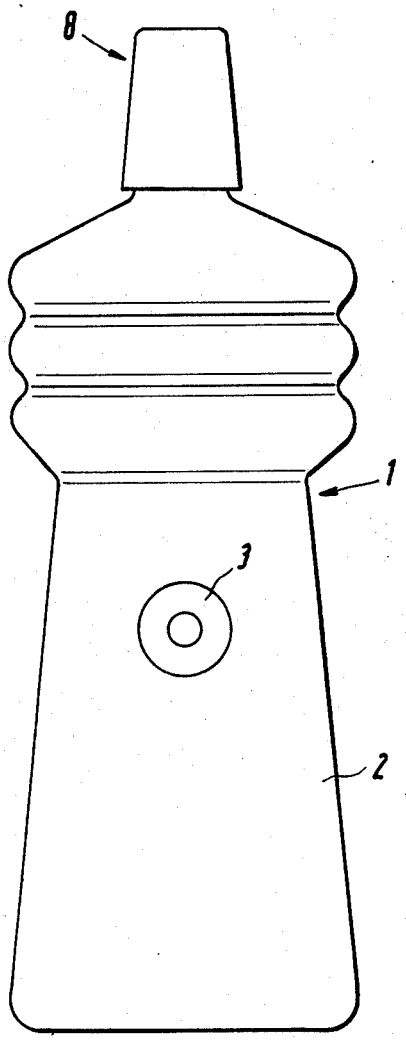
FIG. 1 shows an elevation of the container according to the invention.
Figure 2:
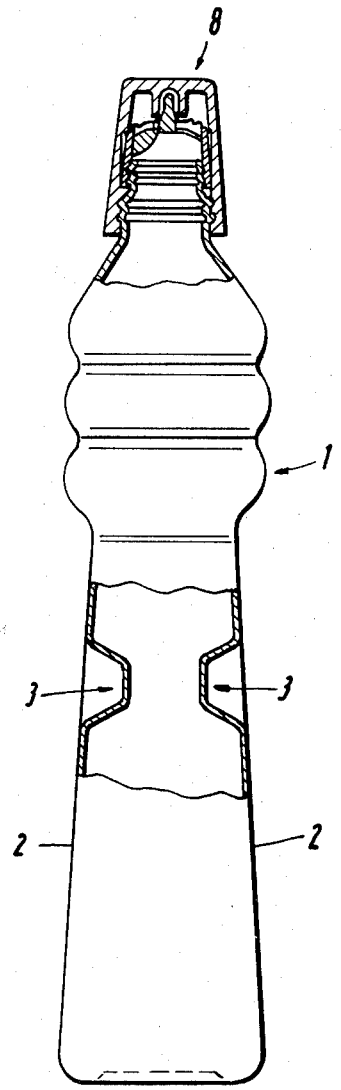
FIG. 2 shows a side elevation, partly in section, of the container according to FIG. 1.
Figure 3:
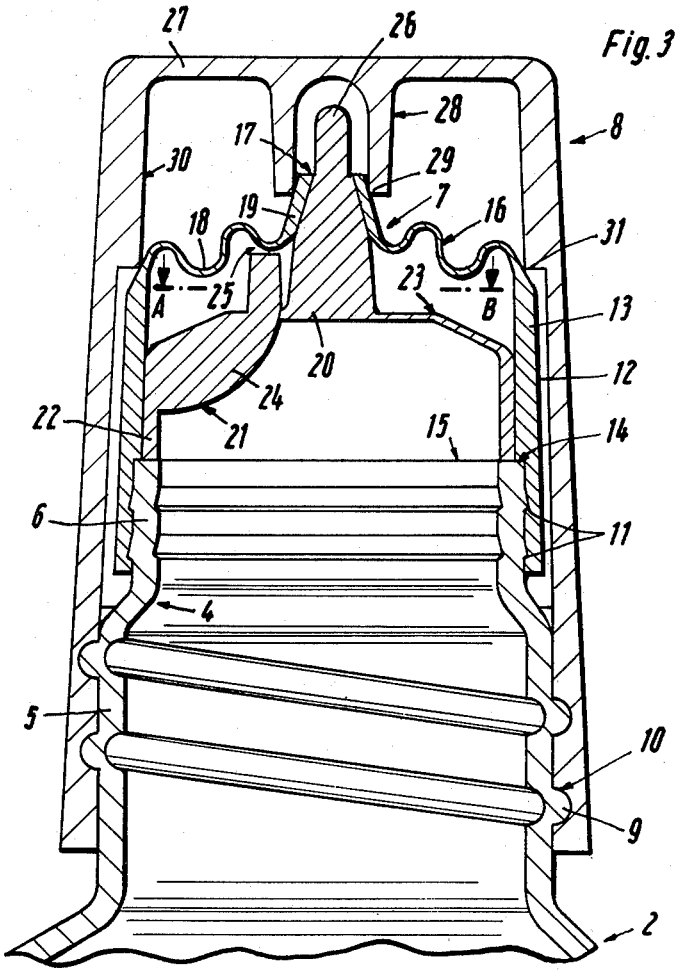
FIG. 3 shows a larger scale sectional view of the safety closure means of the container.

The container 1 consists of a flexible plastic and is made of such a shape that it can easily be gripped and compressed by one hand. The embodiment illustrated is a flat container which exhibits at approximately half its height a constriction ensuring a secure grip. However, any other, e.g., rectangular or rotationally symmetrical shape is equally possible.

At the exit end of the container 1 its wall 2 narrows into an extension 4, which constitutes the open neck of the container and narrows towards the exit in two approximately cylindrical steps 5 and 6. The extension 4 serves as support and guide for the safety closure means conformed as a cone valve 7 and for a cap 8. For this purpose a detent 9 with a preferably rounded surface, helicoidally encircling the extension 4, is moulded onto the outside of the extension step 5 remote from the exit and engages positively into a correspondingly shaped groove 10 on the cap 8. The cap 8 can be applied to the extension 4 by this screw guide means and locked by a rotary movement.

The outside of the extension step 6 close to the exit is constructed as the support of one or more snap catches 11 annularly surrounding the extension 4. Onto these snap catches 11 there is pushed, from the exit side, a cylindrical membrane support 12, the interior wall of which exhibits annular recesses into which the snap catches 11 engage positively and sealingly. The push-on depth of the membrane support 12 is limited by a step 14 recessed annularly in the cylindrical wall 13 of this membrane support and resting flush on the top edge 15 of the extension 4. Such a snap closure means eliminates any accidental release of the membrane support 12 from the container 1 and also makes the deliberate demounting of the safety closure means as difficult as possible.

On the upper free edge of the membrane support 12, covering its open side, there is moulded a membrane 16 which exhibits a central circular hole 17. Concentrically extending undulations 18 are shaped round this hole 17. The edge of the hole 17 may be dimensioned as a sealing edge per se. In a preferred embodiment the membrane 16 is raised conically outwards at this hole 17 towards the exit and forms a sleeve 19 tapering towards the exit and in sealing contact with the valve cone 20 inserted throught the hole 17. The valve cone 20 and the sleeve 19 of the membrane 16 co-operate in the function as a safety closure means for the container 1.

The valve cone 20 is mounted elastically resiliently in the axial direction. A cylindrical moulding 21, which rests by its edge 22 remote from the exit upon the top edge 15 of the container 1, and from the top marginal edge of which moulding radial stays 23 are drawn inwards, serves as holding and support means for the valve cone 20. The wall 13 of the membrane support 12 constitutes a housing, into which the moulding 21 is inserted as a press fit. The moulding 21 is fixed in its position on the container by the membrane support 12, applied as a union fitting.

Figure 4:
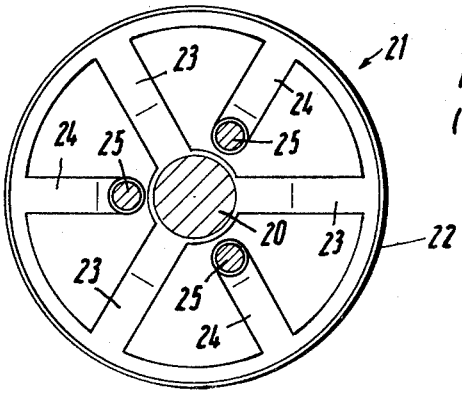
FIG. 4 shows a plan of a section through the safety closure means of the container along the line A—B in FIG. 3.

The valve cone 20 is arranged centrally as a hub at the junction of the stays 23 of the moulding and is mounted resiliently with movement play in the axial direction by the stays 23 extending spoke fashion. In the embodiment illustrated (FIG. 4) three stays 23 arranged at an angular interval of 120° are provided, which give the moulding 21 a triple symmetry with reference to the valve cone axis.

In the centre of the angle between each two stays 23, i.e., again staggered at 120° in each case, three lugs 24 directed upwards towards the underside of the membrane 16 are moulded on the marginal edge of the cylindrical part of the moulding 21. The tips 25 of these lugs 24 terminate at a short distance beneath the membrane 16, so that they do not touch the latter in the rest state. By the choice of a suitable material thickness, the lugs 24 are substantially rigid in contrast to the stays 23. The lugs serve as a stop and limit the movement of the diaphragm 16 in the axial direction.

Preferably two mutually opposite indentations 3 directed into the interior of the container are moulded in the wall 2 of the container 1, and mark a particularly suitable point for pressure on the container wall 2 for the purpose of withdrawing liquid. Each indentation 3, by its size, permits the engagement of at least one fingertip. When the container wall 2 is pressed in at the indentations 3, the interior volume of the container is reduced by a specific quantity which is determined by the spacing of the container walls and limited by a stop position in which the container walls touch each other internally in the indentations 3. The quantity of liquid to be dispensed can therefore be accurately dosed by finger-pressure upon the indentations 3 of the container wall 2. Individual indentations, a plurality of indentations defining, in a practical manner, differently sized dispensing volumes, or pairs of such indentations may be provided on the container 1. Of course, pressure can also be exerted upon any desired other part of the container wall 2, and liquid thereby dispensed.

The components of the container 1 according to the invention co-operate in the following manner. By pressing in the wall 2 an excess pressure is generated within the container 1, which lifts the sleeve 19 of the membrane 16, which sleeve seals against the valve cone 20 with appropriate pretension, from the valve cone 20. The movement play necessary for this purpose is provided by the concentric bellows undulations 18 of the membrane 16. By the lifting of the membrane 16 an annular gap, through which the liquid can emerge from the container 1, is opened at the sealing surface between sleeve 19 and valve cone 20. The liquid flows through the holes left in the moulding 21 between the stays 23 and lugs 24, along the valve cone 20, through the annular gap and is united not later than at the appropriately shaped tip 26 of the valve cone 20, into an integral jet which separates there.

At the end of the discharge operation, when the excess pressure built up in the container falls below a threshold determined by the pretension of the membrane 16, the sleeve 19 is applied to and seals the valve cone 20, closes the annular gap without delay and thus prevents the inflow of any possibly flammable gas/air mixture into the container. The partial vacuum produced in the interior of the container after the relaxation of the manual pressure upon the wall 2 is not compensated automatically, but only by a manually operated ventilation of the container. For this purpose the valve cone 20 is depressed axially counter to the spring force of the stays 23 by its tip 26 projecting through the sleeve 19. The membrane 16 in sealing contact with the valve cone 20 then strikes the lugs 24, which limit the axial accompanying movement of the membrane 16, lift the sleeve 19 from the valve cone 20 and thereby ventilate the container 1. After ventilation, which is achieved by only a brief pressure upon the tip 26 of the valve cone 20, has occurred, the latter springs back into its sealing position by virtue of the elastic stays 23.

The function of the safety closure means as explained therefore separates the process of dispensing liquid from the container 1 in chronological sequence from that of pressure equalisation, and therefore effectively prevents hot flame gases from being sucked into an explosive gas/air mixture. With the container according to the invention, a highly flammable liquid can be sprayed into an open fire without concern.

The manual ventilation of the container is most simply performed by a touch on the container orifice, and therefore quite automatically away from any source of danger. Accidental faulty operation is impossible.

Overdosing of the liquid dispensed is also prevented by the arrangement of indentations 3 in the container wall 2.

The configuration of the cap 8, which closes the container 1 during transport or during long periods of storage, represents a further safety factor. On the inside of the cover plate 27 of the cap 8 there is moulded centrally and coaxially a cylindrical spigot 28 which fits over the tip 26 of the valve cone 20, whilst the inner edge 29 of the spigot 28 engages over the sleeve 19 of the membrane 16. When the cap 8 is screwed onto the extension 4, the inner edge 29 presses upon the sleeve 19 and locks the membrane 16 in a position pressed sealingly against the valve cone 20. The safety closure means 7 is thereby fixed in its closed position and the container 1 is protected from spilling.

There is also moulded on the interior wall 30 of the cap 8 an annular step 31 which touches the top edge of the wall 13 of the membrane support 12 when the cap 8 is applied. When the cap 8 is screwed onto the extension 4, the step 31 presses sealingly onto the membrane support 12 at this point and separates the space enclosed by the cap 8 hermetically from the environment. Therefore if liquid should escape from the container 1 by excessive pressure on the container wall 2, extraordinarily high temperatures or damage to the safety closure means, it remains encapsulated beneath the cap 8. The step 31 serves simultaneously as a locking means which prevents the cap 8 from being screwed too deeply onto the container 1.

The container according to the invention guarantees safe dealing with highly flammable liquids by the possibility of accurate quantity dosing, the safety closure means with strike-back barrier and the sealing cap. All components of the container can be produced simply and economically. In comparison to unsecured spray bottles according to the prior art, only one additional moulding is required.

We claim:

1. A container particularly for dispensing a highly flammable liquid, comprising flexible compressible container walls, a safety closure means and a removably attached cap, whereby the safety closure is a membrane controlled cone valve operable by reduction of the interior space of the container, the membrane having a central hole bounded by a sealing edge, through which a valve cone, against which the sealing edge abuts, is engaged, and being constructed with undulations extending concentrically around the central hole, the valve cone is arranged as a hub of an annular plate resiliently yielding in the axial direction and provided with holes formed by radial stays connected to an upper marginal edge of cylindrical moulding, which is inserted as a press fit into a membrane support beneath the membrane, wherein the central hole of the membrane is bounded by an upwardly projecting sleeve conically abutting the valve cone and constituting the sealing edge.

2. A container according to claim 1, and further comprising a stop, said stop limiting the axial movement of the membrane supported by the resiliently mounted valve cone.

3. A container according to claim 2, wherein said stop for the membrane comprises substantially rigid lugs moulded onto the annular plate and directed upwards towards the membrane.

4. A container according to claim 1, wherein said cap comprises a spigot means for overlapping and pressing said membrane sleeve against said valve cone upon attachment of said cap to said container.

5. A container according to claim 4, wherein said membrane further comprises a marginal portion and said cap further comprises an interior wall and a step means of said interior wall for engaging said marginal portion sealingly when said cap is attached to said container.

6. A container according to claim 1, wherein the container wall comprises limit means, comprising at least one indentation protruding into the interior of said container, for limiting compression of said container and the amount of liquid dispensed by said container.

7. A container according to claim 6, wherein said limit means further comprises at least two mutually engageable indentations in said wall.

* * * * *